United States Patent [19]

James et al.

[11] 4,160,202

[45] Jul. 3, 1979

[54] ANALOGUE AUTOMATIC VOLTAGE CONTROLLER

[75] Inventors: Barry K. James, Solihull; David R. Terry, Nettleham, both of England

[73] Assignee: Dresser Industries, Inc., Dallas, Tex.

[21] Appl. No.: 853,788

[22] Filed: Nov. 21, 1977

[30] Foreign Application Priority Data

Dec. 15, 1976 [GB] United Kingdom ..... 52240/76

[51] Int. Cl.[2] ..... B03C 3/68

[52] U.S. Cl. ..... 323/24; 55/105; 323/9

[58] Field of Search ..... 55/105; 323/9, 19, 24

[56] References Cited

U.S. PATENT DOCUMENTS

| | | | |
|---|---|---|---|
| 3,745,749 | 7/1973 | Gelfand | 55/105 |
| 3,772,853 | 11/1973 | Burge et al. | 323/24 X |
| 3,959,715 | 5/1976 | Canning | 323/19 |

*Primary Examiner*—A. D. Pellinen
*Attorney, Agent, or Firm*—Paul E. Krieger

[57] ABSTRACT

A control circuit for an electrostatic precipitator, in which an analogue voltage indicative of the desired precipitator electrode potential is stored and periodically increased in the absence of any condition, notably a falling electrode potential, that the desired voltage is excessive in which case the stored potential is reduced.

4 Claims, 4 Drawing Figures

ANALOGUE AUTOMATIC VOLTAGE CONTROLLER

Prior Application: Priority, Great Britain Dec. 15, 1976, Application No. 52240/76.

This invention is concerned with the automatic control of voltage in an electrostatic precipitator.

The operation of an electrostatic precipitator, used industrially to clean waste gases, is such that it is desirable to maintain the maximum electrode potential in the precipitator without permitting sparking or arcing to occur. In view of the constantly changing dust and gas conditions in the precipitator, it is necessary to have automatic means for controlling the precipitator electrode potential.

In our earlier application which issued as U.S. Pat. No. 3,959,715, we disclosed an automatic voltage control circuit for the electrodes of an electrostatic precipitator, the control circuit operating on a mixture of analogue and digital techniques.

It is an object of the present invention to provide an improved precipitator voltage control circuit which is simpler and operates on analogue techniques.

The present invention is a control circuit for an electrostatic precipitator, comprising an analogue store for providing an output voltage representative of a desired precipitator electrode voltage, switch means for selectively increasing or decreasing the voltage in the analogue store, a control circuit connected with the switch means for selecting an increase or a decrease in the stored voltage, and a sensing circuit adapted to be responsive to a falling electrode voltage to provide an output signal for switching said control circuit to cause a decrease in the stored voltage.

An embodiment of the present invention will now be described, by way of example, with reference to the accompanying drawings, in which.

As is normal practice, the precipitator electrodes are energised by the rectified output of the secondary winding of a transformer whose primary winding is energised through inverse parallel thyristors. Control of the firing phase angle of the thyristors clearly controls the energy input to the precipitator and thus the electrode potential.

Figure 1:
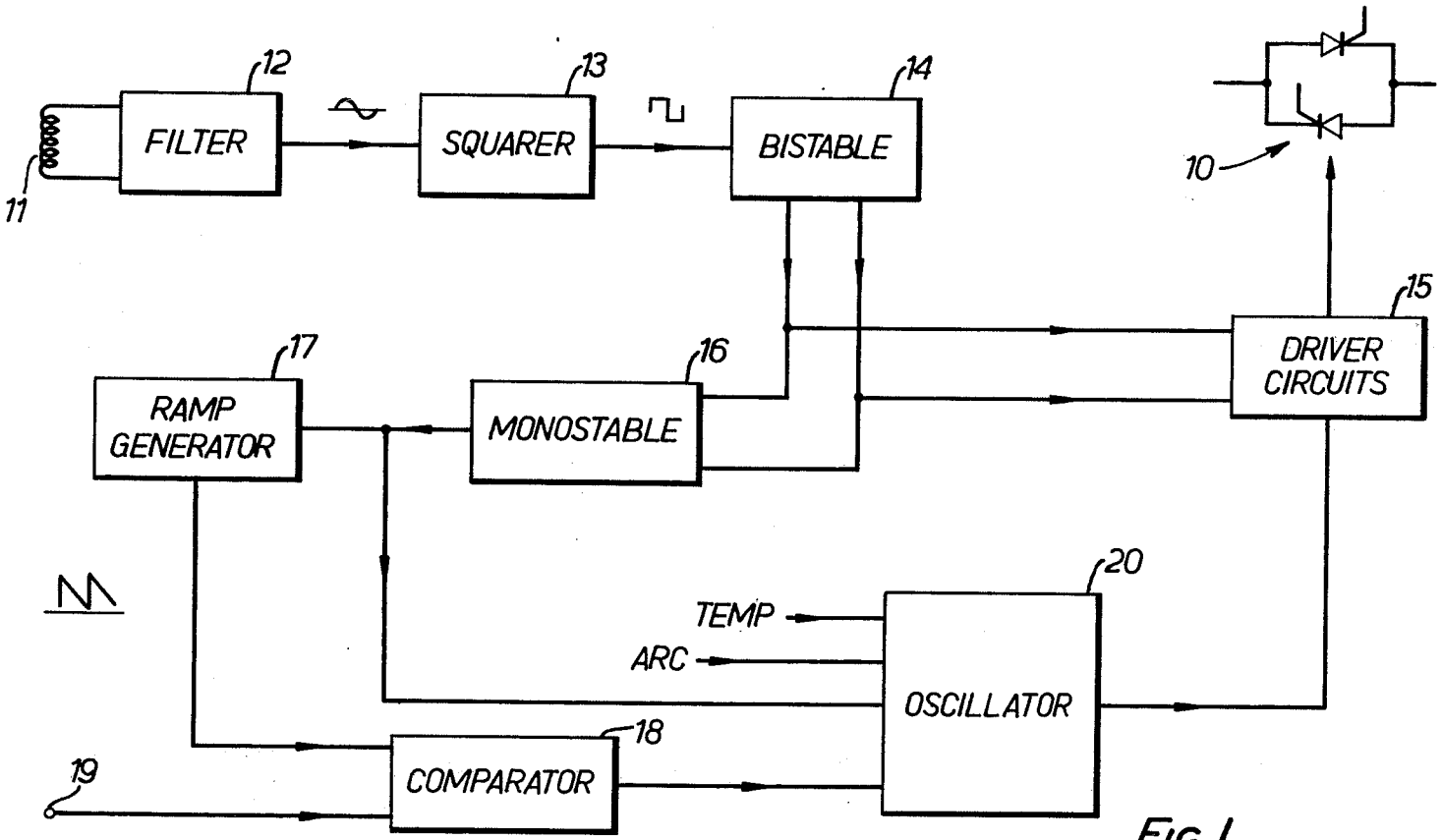
FIG. 1. PRIOR ART
FIG. 1 is a prior art block circuit diagram of a thyristor control circuit used with the automatic voltage controller of FIG. 2.

Referring now to FIG. 1, the basic synchronising and firing circuit for the thyristors 10 is shown. A mains reference signal is supplied at 11 and is subjected at 12 to two stages of two pole active filtering with the resonant frequencies of the stages centered on 50 Hz to reject unwanted harmonics around zero crossover. The filtered sine wave is converted in a shaping circuit 13 to a square wave whose leading and trailing edges are accurately located on the zero crossover points of the reference sine wave. The output from the shaping circuit 13 is passed to a bistable 14 whose output pulses, synchronised with the zero crossover points, are connected to an output driver circuit 15 for the thyristors 10 and to a monostable circuit 16 whose output pulses, one every half cycle of the reference sine wave, have a duration of ½ mS. The pulses from circuit 16 are used to reset a ramp generator 17 whose output voltage is compared in a comparator 18 with a voltage at 19 which is an analogue as will be explained with reference to FIG. 2, of the desired electrode potential. When the ramp voltage from the generator 17 falls to the analogue voltage at 19, the comparator 18 triggers a burst fire oscillator 20 whose output is supplied to the thyristors 10 via driver circuit 15, the circuit 15 including a bistable which toggles on zero voltage crossover, in response to the signals from the output of the bistable 14, to select the appropriate thyristor to fire.

Inhibit inputs to the oscillator 21 are provided to protect against a self-sustaining arc or excess temperature in the precipitator electrodes. Also, to ensure accurate firing of the thyristors the output of the monostable 16 is supplied as an inhibit input to the oscillator 20 so that there exists a ½ mS delay between extinguishing one thyristor and firing the other.

The circuit so far described in conjunction with FIG. 1 is prior art and is in principle well known and depends on its operation on the provision at the terminal 19 of a suitable analogue voltage. This voltage is supplied by the automatic voltage controller illustrated in FIG. 2.

Figure 2:
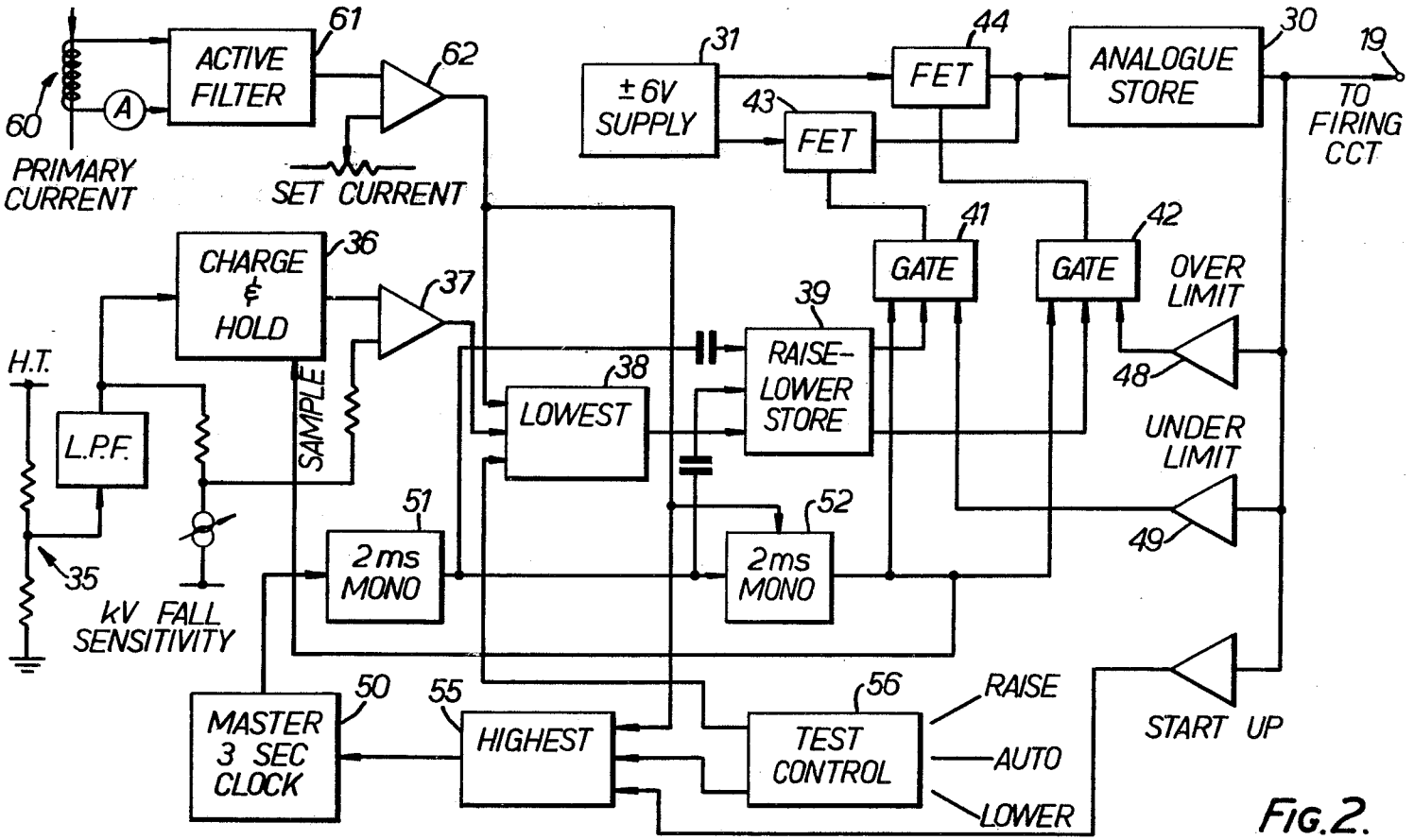
FIG. 2 is a block circuit diagram of an automatic voltage controller according to the present invention.
Figure 4:
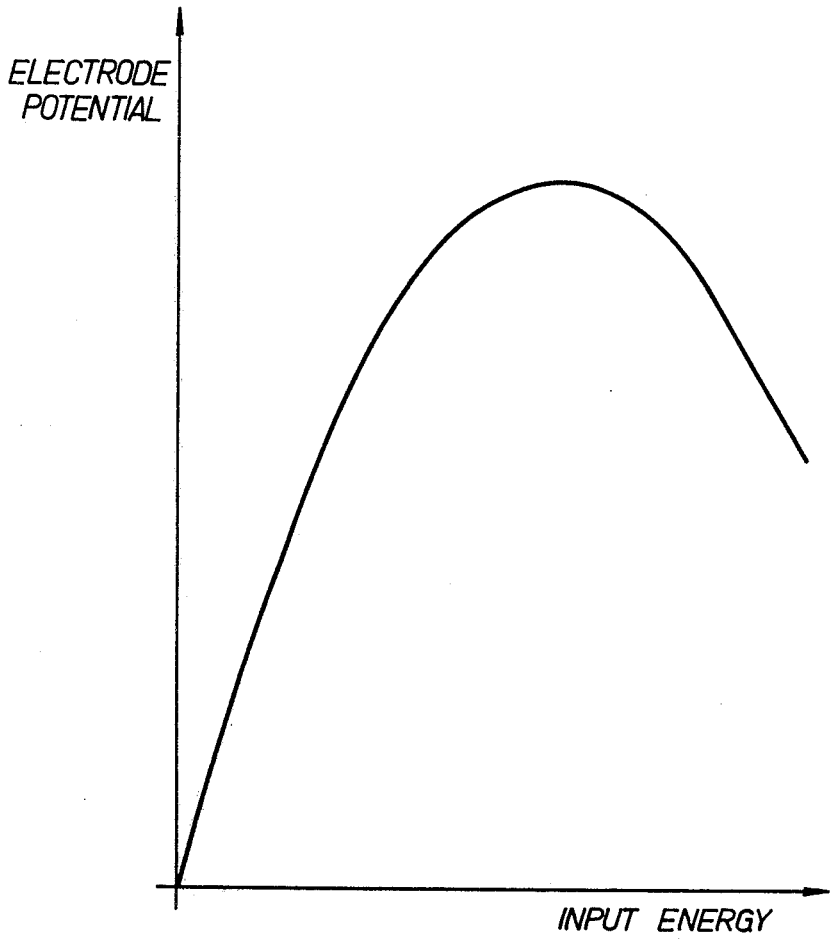
FIG. 4 illustrates the electrode potential/input energy characteristic of an electrostatic precipitator.

Referring to FIG. 2, the analogue signal at 19 is supplied by an analogue store 30 comprising a very long time constant integrator configuration, around a low bias current, low offset voltage temperature coefficient, operational amplifier. The stored analogue voltage, essentially the charge on a capacitor, is periodically increased until the electrode potential begins to fall, i.e. with reference to FIG. 4 the precipitator is sparking and is operating to the right of the peak of the characteristic.

The voltage in the store is then reduced to reduce the input energy and increase the electrode potential to its maximum at which point the precipitator is operating most efficiently.

The electrode potential is sensed at a potential divider 35, filtered in a low pass filter 34 and sampled, normally every 3 seconds as will be explained, into a charge and hold circuit 36. The potential is then compared in comparator 37 with the then current electrode potential. If the difference exceeds a comparator threshold, then the output from the comparator 37, passing through a gate circuit 38, switches a control circuit in the form of a bistable memory 39 upon receipt of a synchronising signal from monostable 51. The memory 39 has two outputs, for "raise" and "lower" respectively, and is biased to provide a "raise" output unless there is an output from the circuit 38. The "raise" and "lower" outputs from the memory 39 enable respective diode gate circuits 41 and 42.

Figure 3:
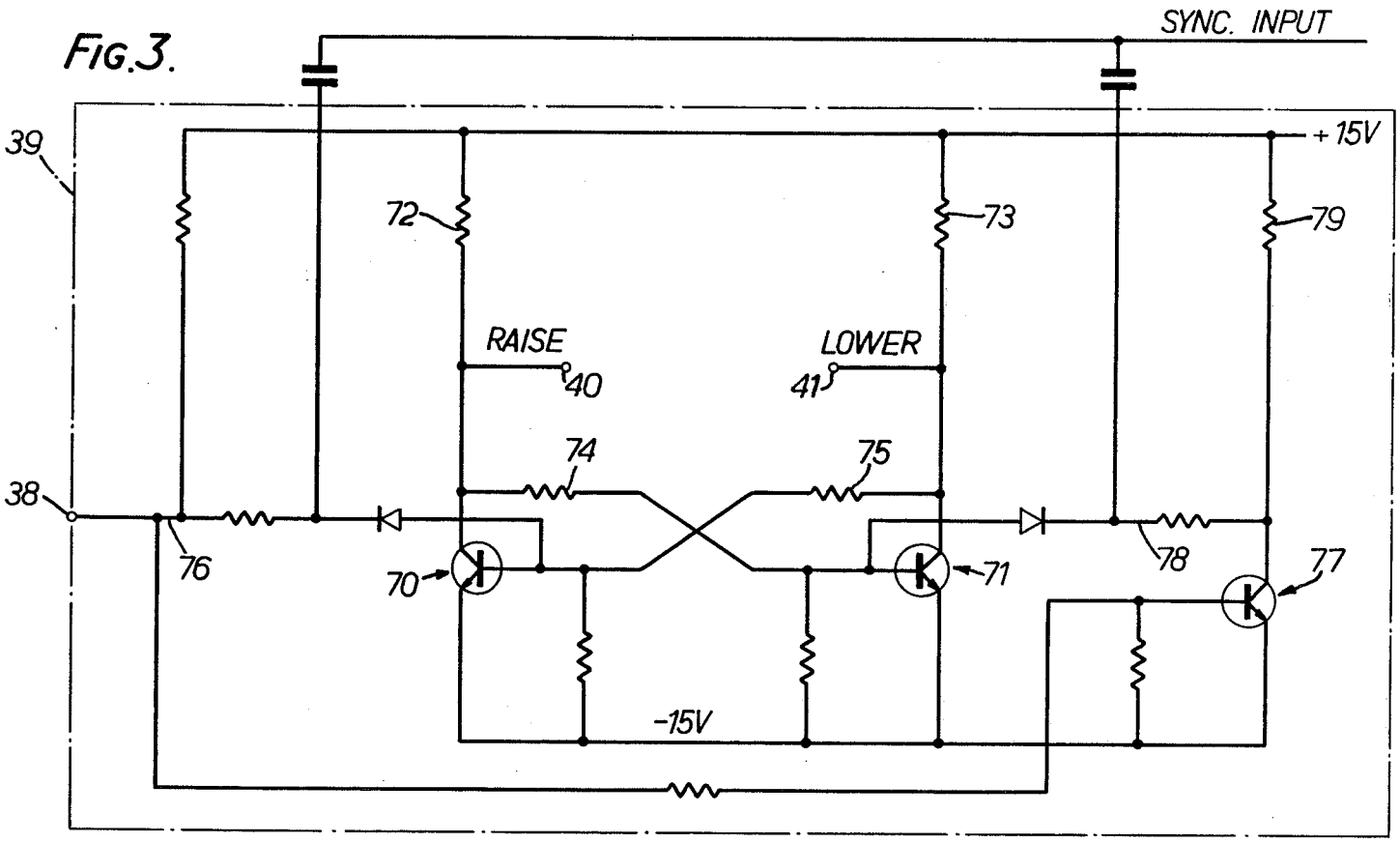
FIG. 3 is a detailed circuit diagram of a bistable circuit used in FIG. 2.

The memory 39 is illustrated in detail in FIG. 3. The transistors 70 and 71 together with the resistors 72 to 75 form a bistable memory circuit. The potential at point 76 is determined by circuit 38 of FIG. 2, and is low if any input to 38 is low. In such a case transistor 77 is non-conducting and the point 78 is, via resistor 79, high.

Upon receipt of a synchronising pulse from the monostable 51 transistor 70 is switched off and, by regenerative action, transistor 71 is switched on, giving high and low signals on the lower and raise outputs respectively.

When the input from circuit 38 is not low, i.e. it is desired to raise the store voltage, point 76 is high and transistor 77 is conducting making point 78 low. Receipt of a synchronising pulse then causes transistor 71 to switch off and transistor 70 to switch on to place the bistable in the "raise" mode.

Thus the bistable changes mode upon receipt of a synchronising pulse after the signal from 38 changes and maintains itself in the raise mode in the Absence of a low signal from circuit 38.

Timing in the controller is supervised by a master clock oscillator 50, of a nominal 3 second period, connected to first and second 2 mS monostables 51 and 52 connected in cascade. The first monostable 51 synchronises the memory 39 while the second monostable 52 times the sample input of the charge and hold circuit 36 and also passes through the enabled gate, 41 or 42, to respective FET circuits 43 and 44 which operate on the store 30 to increase and decrease respectively the closed analogue voltage.

The output voltage at the terminal 17 is monitored by over and under limit circuits 48 and 49 and, if the preset limits are exceeded, inhibiting signals are provided by the circuits 48 and 49 to the respective circuits 42 and 41 to cause corrective action to be taken.

The master clock oscillator 50 can have its frequency increased via gate circuit 55 during start up, when under test raise/test lower control at 56 or when the precipitator is being controlled in a constant current mode, this mode of operation overriding the voltage control.

In the current limit mode, the current usually being set as the maximum output current of the rectifier which supplies the electrodes, the electrode current is sensed by a current transformer 60 and passed through an active filter network. If the primary current exceeds a threshold at a comparator 62, the store 30 is inhibited from being raised and if the overcurrent is large enough the store 30 will be lowered. Because of the action of the gate circuit 55 and a linear adjustment of the pulse width of the monostable 52 under the control of the output of the comparator 62, the greater the overcurrent the quicker will the lowering action be.

We claim:

1. A control circuit for an electrostatic precipitator, comprising an analogue store for providing an output voltage representative of a desired precipitator electrode voltage, switch means for selectively increasing or decreasing the voltage in the analogue store, a switch control circuit connected with the switch means for selecting an increase or a decrease in the stored voltage, and a sensing circuit adapted to be responsive to a falling electrode voltage to provide an output signal for switching said switch control circuit to cause a decrease in the stored voltage, said sensing circuit including a comparator to which are supplied a voltage indicative of the electrode voltage and a delayed sample of that voltage.

2. A control circuit as claimed in claim 1, in which said switch control circuit is also responsive to an indication of excess electrode current.

3. A control circuit as claimed in claim 1, in which said switch control circuit includes a bistable memory circuit operable to provide an output signal calling for an increase in the stored voltage in the absence of an input signal calling for a decrease.

4. A control circuit as claimed in claim 2, in which said switch control circuit includes a bistable memory circuit operable to provide an output signal calling for an increase in the stored voltage in the absence of an input signal calling for a decrease.

* * * * *

UNITED STATES PATENT AND TRADEMARK OFFICE

CERTIFICATE OF CORRECTION

PATENT NO. : 4,160,202

DATED : July 3, 1979

INVENTOR(S) : Barry K. James et al.

It is certified that error appears in the above—identified patent and that said Letters Patent is hereby corrected as shown below:

Cover Page, Assignee: delete "Dresser Industries, Inc., Dallas, Texas: and substitute therefor --Lodge Cottrell Limited, Birmingham, England--.

Signed and Sealed this

*Sixteenth* Day of *March 1982*

[SEAL]

*Attest:*

*Attesting Officer*

GERALD J. MOSSINGHOFF

*Commissioner of Patents and Trademarks*